US006462293B2

(12) United States Patent
Nakamura et al.

(10) Patent No.: US 6,462,293 B2
(45) Date of Patent: Oct. 8, 2002

(54) ELECTRIC POWER SOURCE BREAKER

(75) Inventors: Goro Nakamura; Takahiro Sato, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/779,561

(22) Filed: Feb. 9, 2001

(65) Prior Publication Data

US 2001/0013465 A1 Aug. 16, 2001

(30) Foreign Application Priority Data

Feb. 15, 2000 (JP) ..... 2000-037002

(51) Int. Cl.[7] ..... H01H 9/24
(52) U.S. Cl. ..... 200/318.1; 200/43.13
(58) Field of Search ..... 200/318.1, 319, 200/322, 43.08, 43.13, 43.18, 572, 430, 434, 436, 445, 446, 470, 471

(56) References Cited

U.S. PATENT DOCUMENTS 4,410,775 A 10/1983 Howard

FOREIGN PATENT DOCUMENTS

JP 11-204015 7/1999

*Primary Examiner*—Renee Luebke
(74) *Attorney, Agent, or Firm*—Finnegan, Henderson, Farabow, Garrett & Dunner, L.L.P.

(57) ABSTRACT

The present invention provides a power source breaker which can forcedly and surely isolate a power supply circuit in case of abnormalities such as short circuiting of a wire harness, collision of road vehicles, and also has a structure suitable for miniaturizing itself. Only by changing a rotation angle of the rotary axle 19 on the lock 18 which is assembled rotatable around the central axis of a rotary axle 19 along a plane perpendicular to the sliding direction of said shaft 16, both constraining the shaft 16, pushed by said release spring 17, at the initial position where a pair of the terminals 15*a*, 15*b* intervened in a power supply circuit is set in the connected state with each other and moving the shaft to the isolated position where a pair of the terminals 15*a*, 15*b* intervened in the power supply circuit is set in the released state.

6 Claims, 9 Drawing Sheets

ELECTRIC POWER SOURCE BREAKER

BACKGROUND OF THE INVENTION

The present invention relates to an electric power source breaker which isolates a power supply circuit, for example, by means of rotational movement of a motor, and in particular relates to a power source breaker which can forcedly and surely isolate a power supply circuit in case of something unusual such as short circuiting of a wire harness, collision of road vehicles, and also has a structure suitable for miniaturizing itself.

FIG. 1 is a systematic diagram showing an example for electronic automobile parts to which a conventional power source breaker is applied. As shown in the figure, the electronic automotive part 100 includes a power supply circuit assembled by connecting a battery 101 of an automobile to each load 102–104 disposed at each location of the automobile using a wire harness 106 with electric wires 105, and a power source breaker 107 intervened in the power supply circuit.

When a circuit-cut signal generated at a power source controller 108 is input in case of something unusual such as short circuiting of a wire harness 106 or collision of road vehicles, the power source breaker 107 can stop supplying power from the battery 101 to each load 102–104 etc. through releasing a lock in a manner as described hereinafter according to FIG. 2.

FIG. 2 is a configuration of a solenoid-type power source breaker 107A showing an example of the power source breaker 107 in FIG. 1, and FIG. 2A is a top view and FIG. 2B is a side view. The solenoid-type power source breaker 107A includes a shaft 111, disposed on a base body 110 as shown in FIG. 2A, which is constrained with a lock 113 pressing down the shaft 111 to maintain a terminal 112*a* and a terminal 112*b* electrically continued in a connected state, before the circuit-cut signal is input to the solenoid-type power source breaker 107A at the initial state.

At this initial state, electric current in the power supply circuit flows through the rout of the terminal 112*a* the shaft 111 the terminal 112*b* , and the terminal 112*a* and the terminal 112*b* can supply a large current because of their having the multicontact spring structures.

When the circuit-cut signal is input, by supplying current to a solenoid 115 for drawing a plunger 116 in order to release the lock 113 in a linked state with the shaft 111, pushing forward the shaft 111 by means of pushing force provided by a release spring 114 to make the terminal 112*a* isolated from the terminal 112*b,* finally making the terminal 112*a* electrically open off from the terminal 112*b* to stop supplying power from the battery 101 to each load 102–104 etc.

However, in the conventional structure shown in FIG.2, once an impulse is applied to the shaft 111 in the axial direction shown as an arrow A in the figure, the plunger 116 of the solenoid 115 is liable to malfunction to draw a lever 118, and the malfunction may result in a problem of releasing the lock 113 out of a linked state with the shaft 111. There has been also a problem that a need of miniaturization cannot have been coped with due to the use of the solenoid 115.

SUMMARY OF THE INVENTION

The present invention, in consideration of the situation described above, aims to provide a power source breaker which can forcedly and surely isolate a power supply circuit in case of abnormalities such as short circuiting of a wire harness, collision of road vehicles, and also has a structure suitable for miniaturizing itself.

A power source breaker according to the present invention is such an apparatus that comprises a pair of terminals intervened in a power supply circuit connecting a battery of a road vehicle and each load disposed at each location of the vehicle, and a shaft which can contact with and disconnect from each terminal through sliding movement between each terminal, and isolates said power supply circuit by sliding movement of said shaft from the initial position where each said terminal is set in a connected state with each other to the isolated position where each said terminal is set in a released state with each other. Further, the power source breaker according to the present invention is characterized by comprising: a release spring which provides the shaft with pushing force for sliding movement of said shaft from said initial position to said isolated position; a lock which is assembled rotatable around the central axis of a rotary axle along a plane perpendicular to the sliding direction of said shaft, and can constrain the shaft, pushed by said release spring, at the initial position by means of changing a rotation angle of the rotary axle, and also can make the shaft movable to said isolated position by means of releasing the constraint.

According to the present invention, since only by changing a rotation angle of the rotary axle on the lock which is assembled rotatable around the central axis of the rotary axle along the plane perpendicular to the sliding direction of said shaft, both constraining the shaft, pushed by said release spring, at the initial position where a pair of the terminals intervened in a power supply circuit is in the connected state with each other and moving the shaft to the isolated position where a pair of the terminals intervened in the power supply circuit is set in the released state, the power source breaker can be constructed with a torque generator such as a motor and the like which is simpler and smaller than a linearly driven solenoid. Moreover, since a rotary motion is utilized, whenever any other impulse may be applied onto the power source breaker than those in case of something unusual such as short circuiting of a wire harness, collision of vehicles, the power source breaker is generally not liable to be affected by an impulse which is a composition of linear mechanical vibrations and the shaft can be maintained at a constrained state, and it can be avoided that the lock may be released by virtue of this kind of impulse resulting in sliding movement of the shaft.

Another embodiment of the present invention is characterized by forming a tapered face on a portion of the lock for contact-stopping the shaft from moving. As regards the utilization of the lock wherein the tapered face is formed on the portion for contact-stopping the shaft (hereinafter, refer to the contact-stop portion) from moving in order to avoid promptly the interference with the shaft at an instant isolation movement, it is useful to miniaturize the power source breaker through designing a radius of gyration to be as small as possible.

According to another embodiment of the present invention, it is further characterized by the fact that the lock changes its rotation angle following a rotary movement of a rotary actuator, and a disk is assembled concentrically with a driving shaft of the rotary actuator, providing a protrusion on the periphery of the disk concerned, and a portion of the lock to be linked to said protrusion is released from the protrusion after completion of the isolation movement. According to the invention, whenever any other impulse may be applied onto the power source breaker than those in case of abnormalities such as short circuiting of a wire harness, collision of vehicles, the shaft can be maintained at the constrained state because the lock is actuated by torque, and it can be avoided that the lock may be released by virtue of this kind of impulse resulting in sliding movement of the shaft. Further, since the portion of the lock to be linked (hereinafter, refer to the link portion) to the protrusion of the disk assembled onto a geared motor is released from the protrusion after completion of the isolation movement, the shaft can be immediately reset at the initial position after completion of the isolation movement. Therefore, it is easy to make the power supply circuit return to an electrically closed state. Another embodiment of the present invention is characterized by disposing the lock eccentrically with said rotary axle in such a relation as the contact-stop portion of the lock may be larger than the other portion.

According to the present invention, with regard to the utilization of the lock which is disposed eccentrically with the rotary axle in such a relation as the contact-stop portion of the lock may be larger than the other portion, that is useful to miniaturize the power source breaker through designing a radius of gyration to be as small as possible.

BRIEF DESCRIPTION OF THE DRAWINGS

FIG. 2 is a diagram showing an example of a conventional power source breaker.

DESCRIPTION OF THE PREFERRED EMBODIMENT

Figure 1:
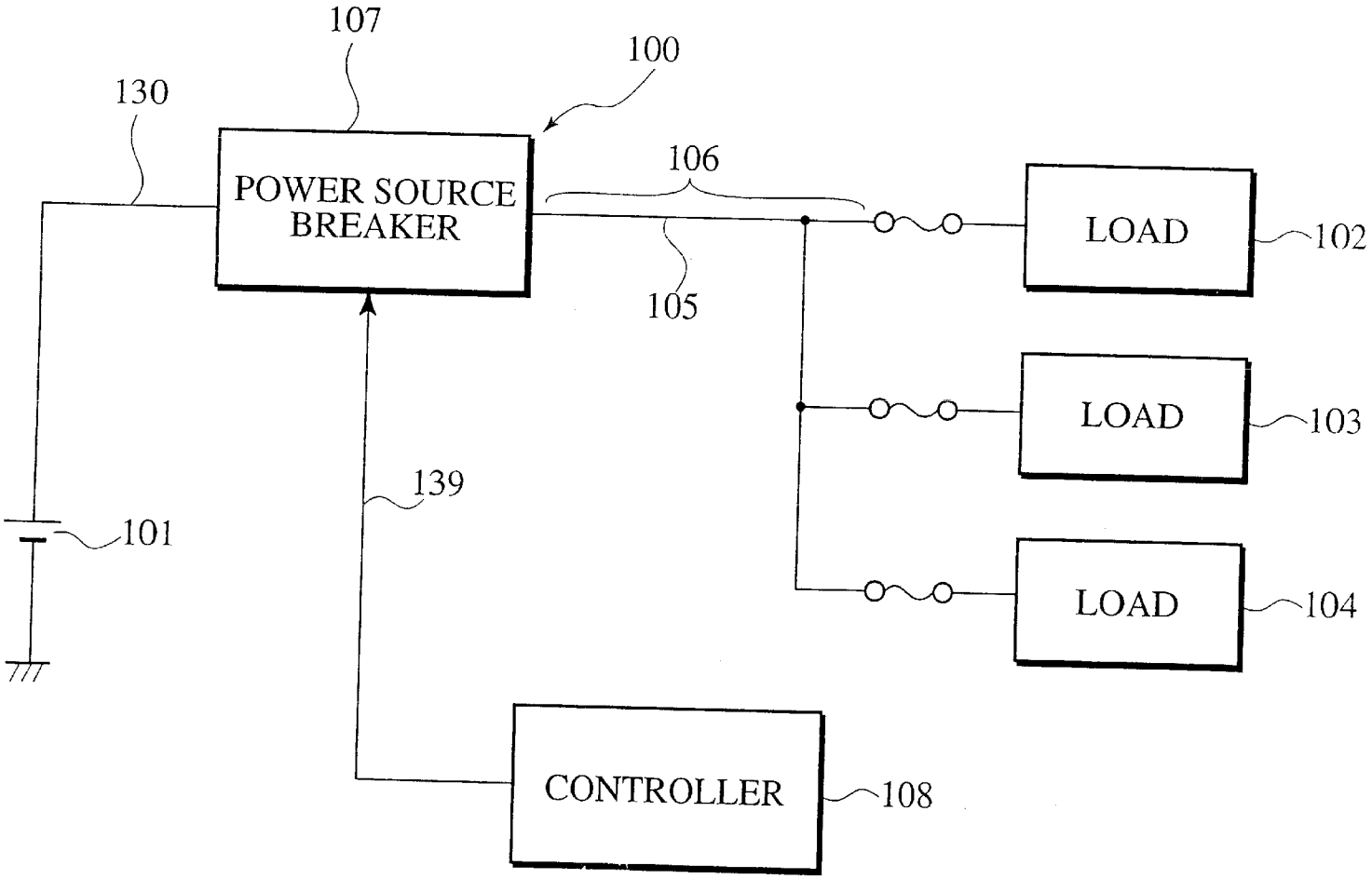
FIG.1 PRIOR ART
FIG. 1 is a systematic diagram showing an example for electronic automobile parts to which a conventional power source breaker is applied.
Figure 2A:
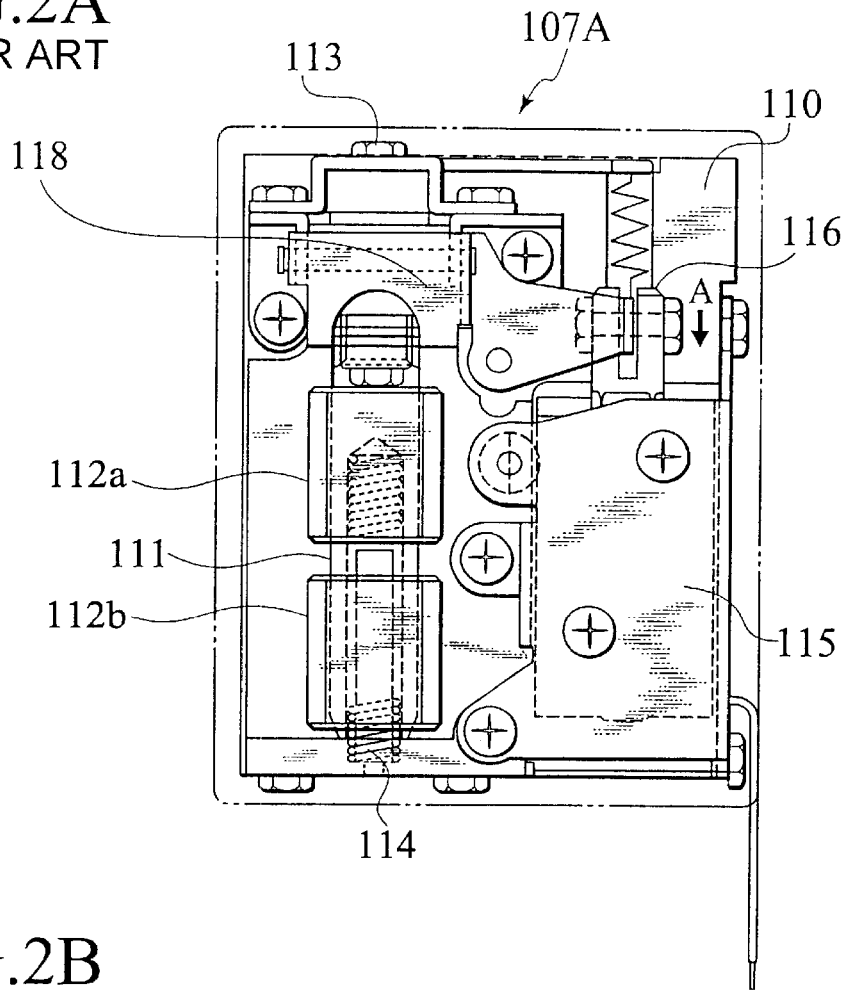
FIG.2A PRIOR ART
FIG. 2A is the top view and FIG. 2B is the side view.
Figure 2B:
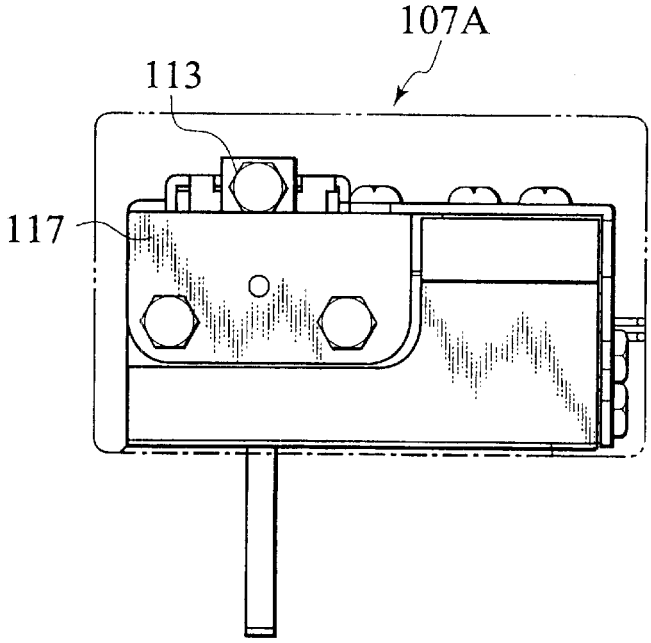
FIG.2B PRIOR ART
Figure 3:
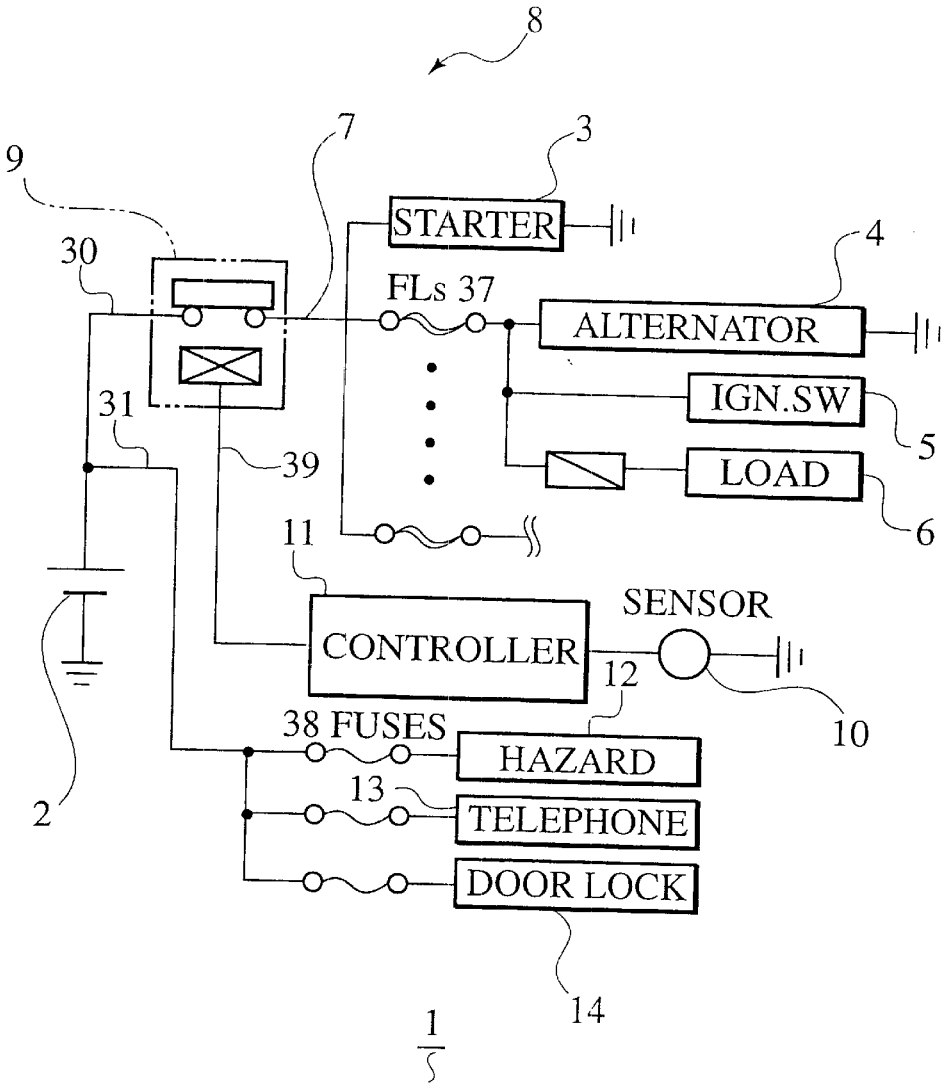
FIG. 3 is a systematic diagram showing an embodiment of an electronic automobile parts system to which a power source breaker according to the present invention is applied.

FIG. 3 is a systematic diagram showing an embodiment of an electronic automobile parts system to which a power source breaker according to the present invention is applied.

As shown in the figure, the electronic automobile parts system 1 includes a power supply circuit formed by connecting, with a wire harness 8 represented as a circuit 7, each load such as a battery 2 of a road vehicle, a starter 3, an alternator 4, an ignition switch (IGN.SW) 5, other loads 6, and the power source breaker 9 according to the present invention intervened between a circuit 30 connected to the battery and the circuit 7. Further, both an abnormality detecting sensor 10 such as a acceleration sensor and a power source controller 11 for isolating the power source according to the detected abnormality like an impulse etc. are used to operate the power source breaker 9. The abnormality detecting sensor detects abnormalities like a collision and a fall as a sudden change of acceleration or occurrence of an impulse, an impulsive sound, an electromagnetic wave, etc., and transmits the occurrence of the abnormalities to the power source controller by means of an electric signal or an optical signal, and moreover a plurality of detecting means or judging means may be used in conjunction with each other.

The output 39 of the controller may be utilized to operate safety equipment like a air bag, an alarm system, or a report system. A hazard light 12, a telephone (PHONE) 13, and a door lock (D/L) 14, are some examples of the system members which need not to be isolated from the power supply circuit by the power source breaker 9, and are supplied with power from the battery through a circuit 31.

Figure 4:
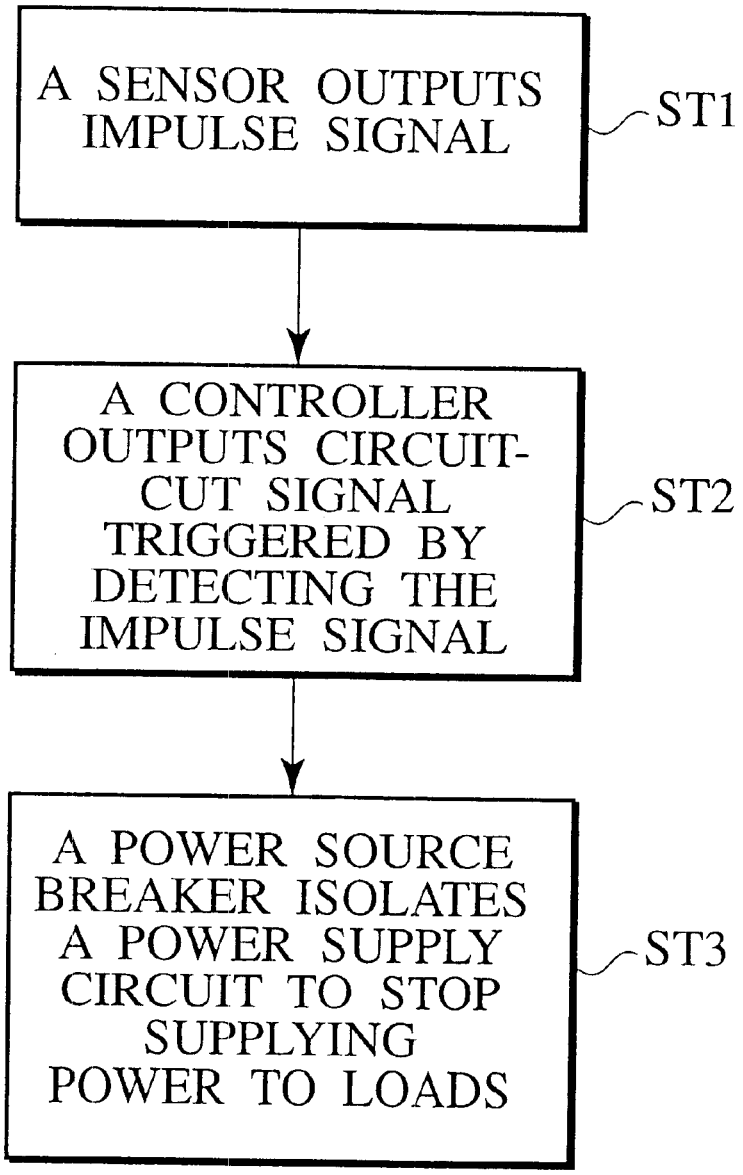
FIG. 4 is a flowchart showing an isolation flow of the electronic automobile parts in FIG. 3.

As shown in the isolation flow of FIG. 4, when a road vehicle collides with a body like a preceding vehicle for example, the sensor 10 outputs an impulse signal to the power source controller 11 (step ST1), and then a circuit-cut signal is generated at the power source controller 11 and the circuit-cut signal generated is output to the power source breaker 9 (step ST2).

Consequently, the power source breaker 9 can isolate the power supply circuit and stop supplying power from the battery 2 to each load such as the starter 3, the alternator 4, the ignition switch (IGN.SW) 5 as will be described below on the basis of FIG. 5–FIG. 8 (step ST3).

Figure 5:
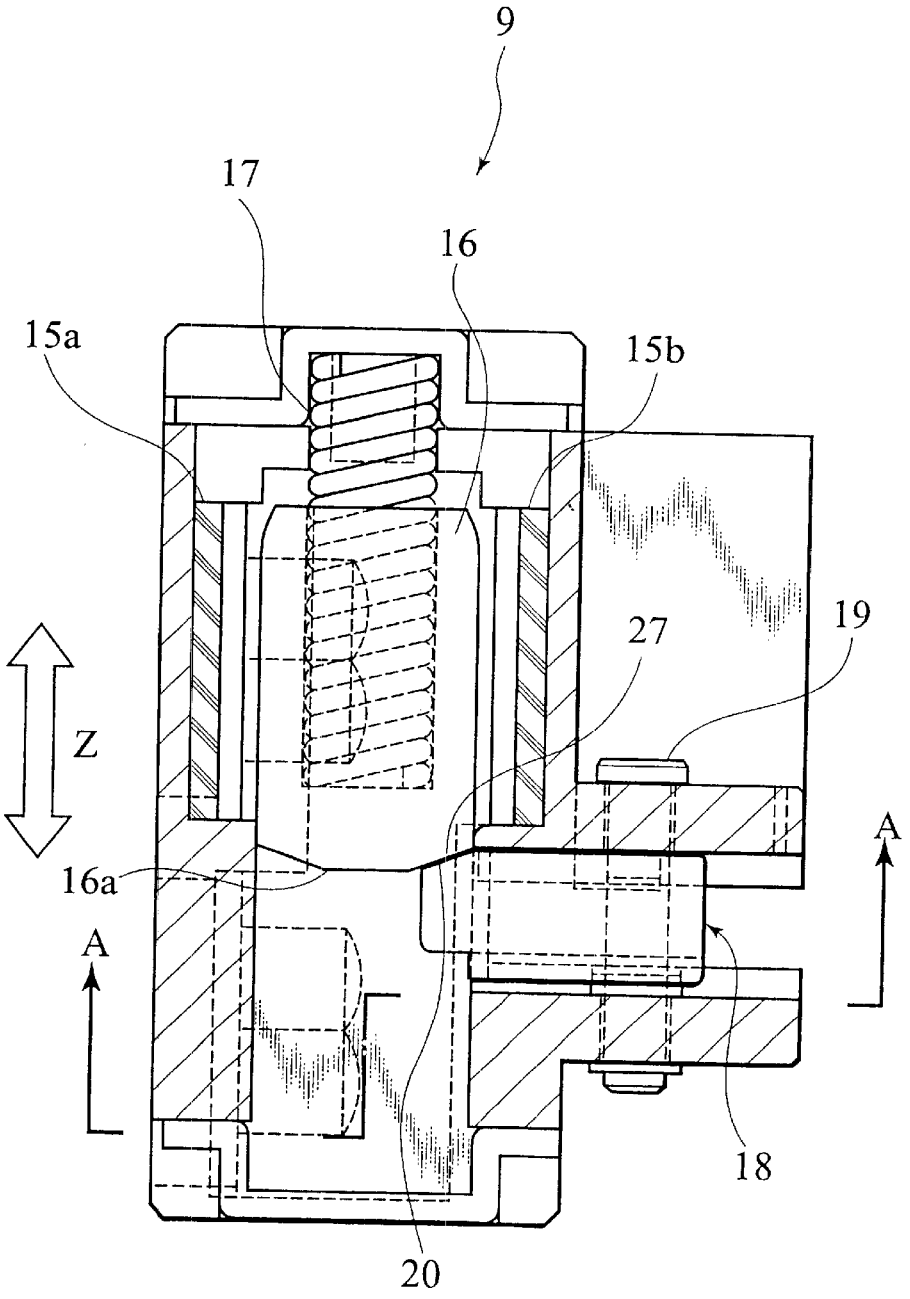
FIG. 5 is a side sectional view of a main structural portion in an embodiment of a power source breaker according to the present invention at a state before operation.
Figure 6:
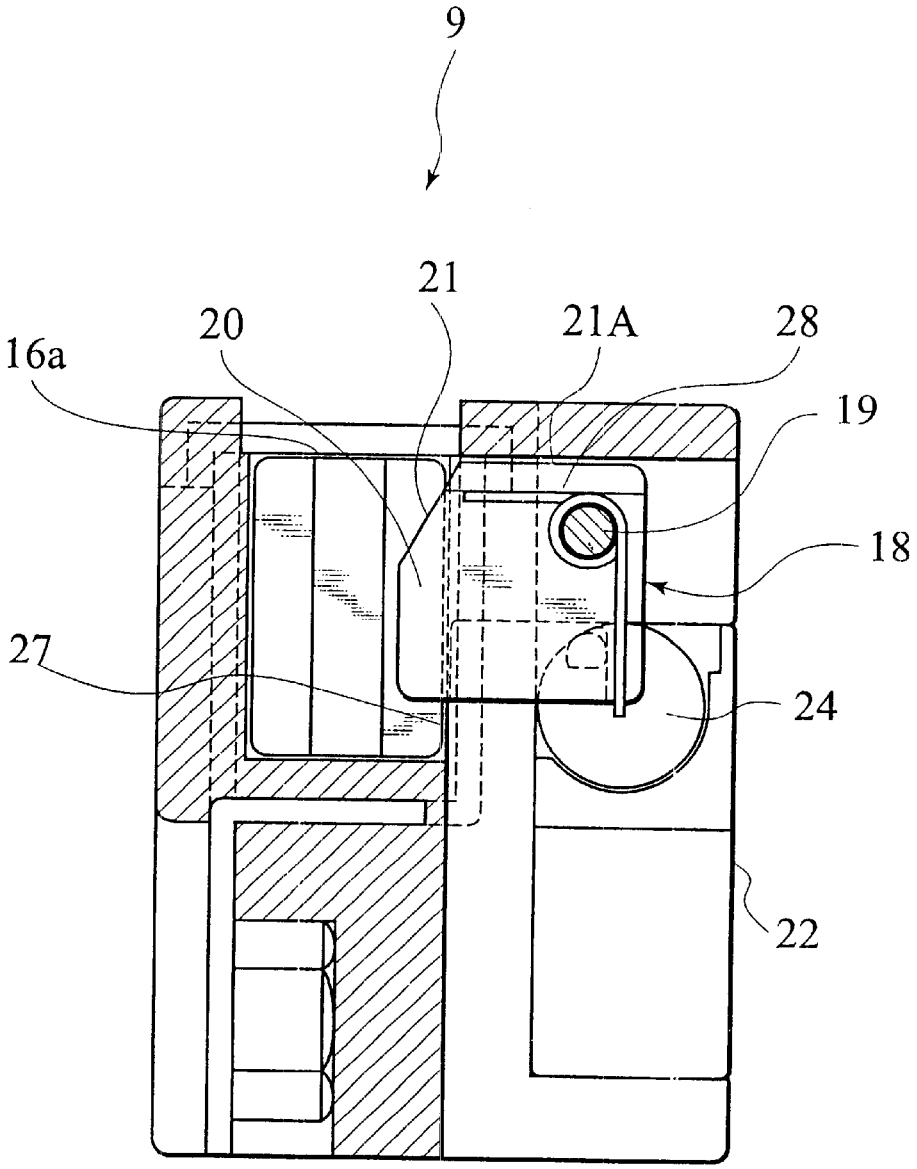
FIG. 6 is a section along the line A-A of the power source breaker in FIG. 5.

FIG. 5 is a side sectional view of a main structural portion in an embodiment of a power source breaker 9 according to the present invention. FIG. 6 is a section along the line A—A of the power source breaker 9 in FIG. 5.

The power source breaker 9 comprises a pair of terminals 15*a,* 15*b* intervened in the power supply circuit connecting the battery of a road vehicle and each load disposed at each location of the vehicle, and a shaft 16 which can contact with and disconnect from each terminal 15*a,* 15*b* through sliding movement between each terminal and is made of an electrically conductive material.

The shaft 16 is forcedly provided with pushing force by a release spring in order to transfer the shaft itself by sliding movement from the initial position where each said terminal 15*a,* 15*b* is set in a connected state with each other to the isolated position where each said terminal 15*a,* 15*b* is set in a released state with each other.

Further, before the shaft 16 operates (at the state shown in FIG. 6), in order to maintain the connected state of the shaft 16 on between each terminal 15*a,* 15*b,* a side face 27 of an end portion 16*a* of the shaft pushed against the direction of sliding movement by the release spring 17 is constrained at the initial position by contact-stopping with a lock 18.

The lock 18 is assembled rotatable around the central axis of a rotary axle 19 along a plane perpendicular to the sliding direction Z of the shaft 16, and in order to avoid the interference with the shaft 16 at a prescribed rotation angle during isolating movement, a tapered face 21 at a prescribed angle to a given plane of the shaft surface is shaped in a contact-stop portion 20 on which the end portion 16*a* of the shaft is contact-stopped.

Further, the lock 18 is forced against a contact wall 21A with a torsion spring 28. The lock 18 rotates around the rotary axle 19 by means of torque generated by a rotary actuator 22 such as a geared motor, and a disk 24 is assembled concentrically with a driving shaft 29 of the actuator and rotatablly in a plane substantially perpendicular to the driving shaft, and moreover a protrusion 25 is provided on the periphery of the disk 24. A link portion 26 for transmitting torque from the protrusion 25 is formed in the shape of an open recess in the lock 18.

In an embodiment of FIG. 7, the link portion 26 comprises 3 faces 26A–C forming the sides of the link portion, and during isolating movement the protrusion 25 of the disk transmits torque to the lock to rotate by means of tight linking with a main action face 26A, and after completion of isolating movement the protrusion 25 rotates further and disconnect from the main action face 26A to make the lock return to the initial position.

Figure 7A:
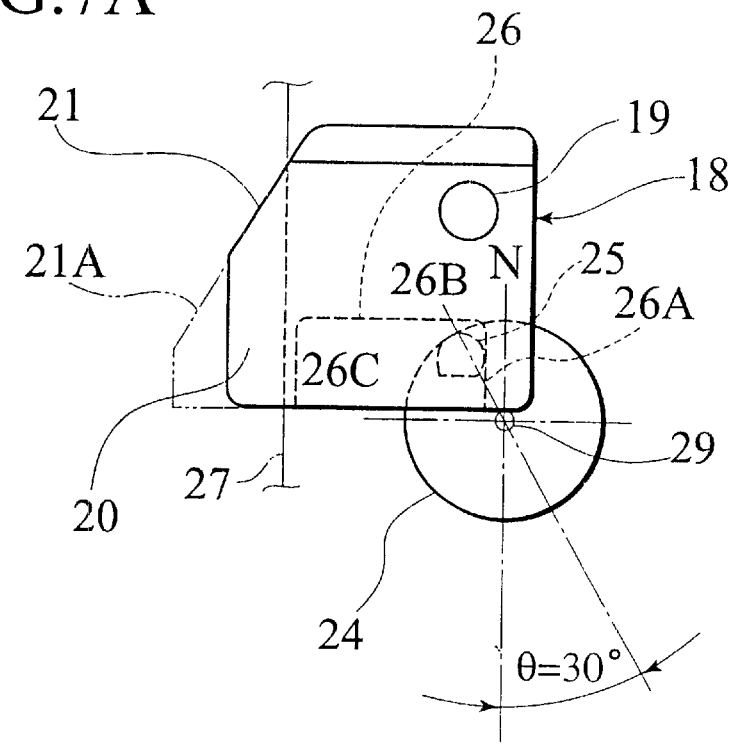
FIG. 7 is a diagram illustrating the action of the lock changing from the locked state (FIG. 7A) to the liberated state (FIG. 7B).
Figure 7B:
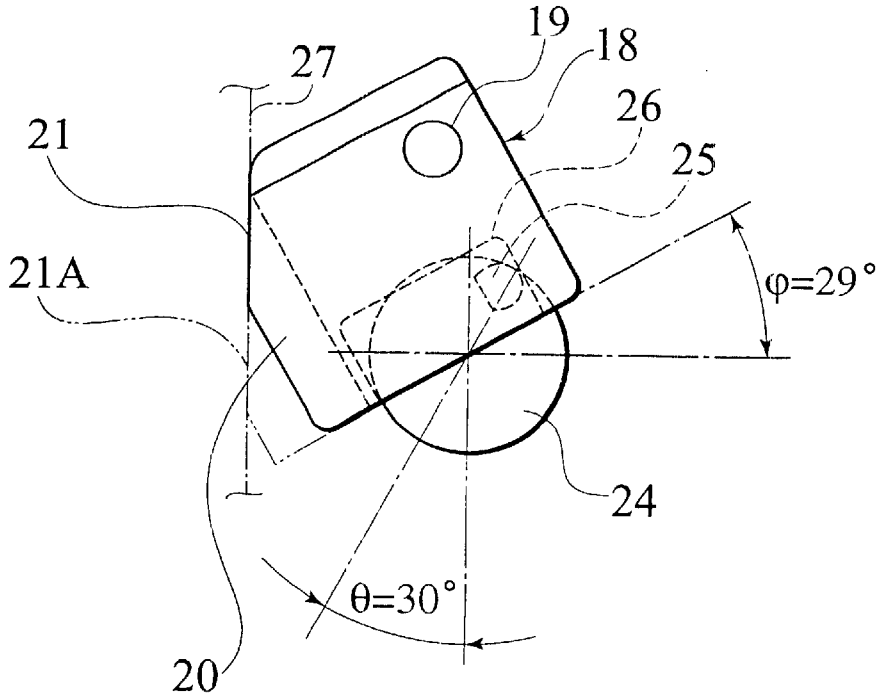

Namely, the lock 18 follows rotation of the actuator 22 derived by input of the circuit-cut signal, and changes the rotation angle around the rotary axle 19 from a locked state (the state before releasing) shown in FIG. 7A to a liberated state shown in FIG. 7B of the figure to cancel the interference region resulting in release of the constraint on the shaft 16.

At the locked state shown in FIG. 7A, the lock 18 is maintained at the position where the protrusion 25 of the disk 24 is rotated counterclockwise at a prescribed angle ($\theta_0$=30°) to the neutral position N, and at the held state the contact-stop portion 20 is contact-stopped and constrained parallel ($\psi_0$=0°) with the side face of the end portion 16*a*.

At the liberated state shown in FIG. 7B, the lock 18 is maintained at the position where the protrusion 25 of the disk 24 is rotated clockwise at a prescribed angle ($\theta_1$=−30°) to the neutral position N. At this state, the lock rotates counterclockwise at a prescribed angle ($\psi_1$=29°), and since mechanical interference is canceled due to the parallel relationship between the tapered face 21 of the contact-stop portion 20 and the side face 27 of the end portion 16*a,* contact-stop of the shaft 16 by means of the lock 18 will be released resulting in sliding movement of the shaft 16 to the isolated position.

The structure shown in FIG. 7 is only an example, and because the angle $\psi(\theta)$ of the lock 18 changes according to the change of the angle $\theta$ of the disk 24, the design of positional relationship among a lock, a disk, a tapered face, a protrusion, or a main action face, etc. can be varied under the condition that the action domain $\{\psi:\psi_0 \leqq \psi \leqq_1\}$ is included in the maximum domain $\{\psi:\psi_{min} \leqq \psi \leqq \psi_{max}\}$ of the rotation angle $\psi$ of the lock.

Figure 8:
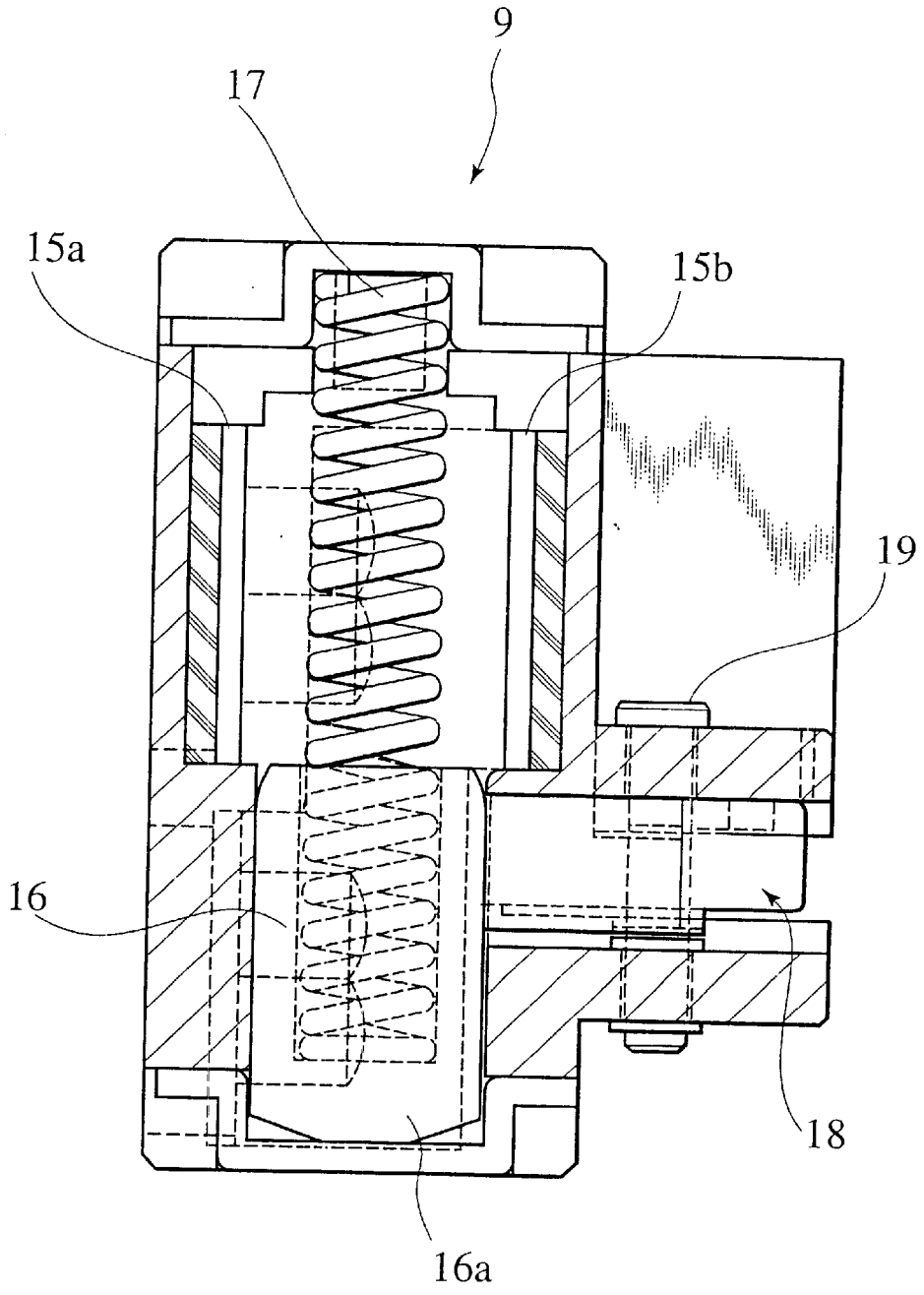
FIG. 8 is a side sectional view of a main structural portion in an embodiment of the power source breaker according to the present invention at a state after operation.

After the shaft 16 (the lock 18) has operated as shown in FIG. 8, because of absence of the shaft 16 as a electrical conductor, a non-connected state is introduced between both the terminals 15*a,* 15*b* and the power supply circuit is isolated.

According to the structure of the present embodiment, only by changing the rotation angle of the lock 18 which is assembled rotatable around the central axis of the rotary axle 19 along the plane substantially perpendicular to the sliding direction of the shaft 16, change over between the locked state and the liberated state becomes possible. Namely, both constraining the shaft 16, pushed by said release spring 17, at the initial position where a pair of the terminals 15*a,* 15*b* intervened in the power supply circuit is set in the connected state with each other, and moving the shaft to the isolated position where a pair of the terminals 15*a,* 15*b* intervened in the power supply circuit is set in the released state are to be done.

While an operation distance (a stroke) is invariable and a size of actuator is liable to be large for its drawing force in the case of using a linearly driven solenoid, continuous control of the rotation angle is easy in the case of using a rotary actuator, and when a gear system is built in the actuator, a wide range of selection for an output torque may be possible without limitation of the torque of the actuator itself and a miniaturized power source breaker can also be constructed.

Because of utilization of the lock 18 wherein the tapered face 21 is formed on the contact-stop portion 20 of the lock 18 for contact-stopping the shaft 16 in order to avoid promptly the interference with the shaft 16 at an instant isolation movement, it is possible to miniaturize the power source breaker through designing a radius of gyration of the lock 18 to be as small as possible.

Further, when a circuit-cut signal is input into the geared motor 22, the rotation angle of the rotary axle 19 is changed to release the constraint on the shaft 16 by means of the lock 18, and isolation movement of the power source breaker will be surely done in case of abnormalities such as short circuiting of a wire harness, collision of road vehicles.

Further, since an impulse generally brings a linear mechanical action or its compositional action, and because the power source breaker of the present invention transmits power through rotary motion of the rotary actuator, whenever any other impulse may be applied onto the power source breaker than those in case of abnormalities such as short circuiting of a wire harness, collision of road vehicles, the impulse only acts on the center of gravity of the breaker to be affected little and it can be avoided that the lock 18 may be released by virtue of malfunction resulting in sliding movement of the shaft 16.

After completion of the isolation movement, since the link portion 26 of the lock 18 linked to the protrusion 25 of the disk 24 is released from the protrusion 25 by further rotation of the rotary actuator 22, the shaft 16 can be immediately reset being forced with the torsion spring and constrained at a prescribed angle $\psi_0(\theta_0)$ with the lock 18, and therefore it is easy to make the power supply circuit return to the electrically closed state.

Because of the utilization of the lock 18 which is disposed eccentrically with the rotary axle 19 so that the contact-stop portion for the shaft 16 may be larger than the other portion, it is useful to miniaturize the power source breaker through designing the radius of gyration to be as small as possible.

For the planar configurations of both the side face 27 of the end portion 16*a* of the shaft and the contact-stop portion 20 of the lock 18, such a configuration can be adopted as it may be in the contact-stopped state through mutual mechanical interference during the locked state and free of interference during the liberated state. For example, in an embodiment of FIG. 7, the length of the tapered face 21 can be changed like a broken line 21A.

Figure 9A:
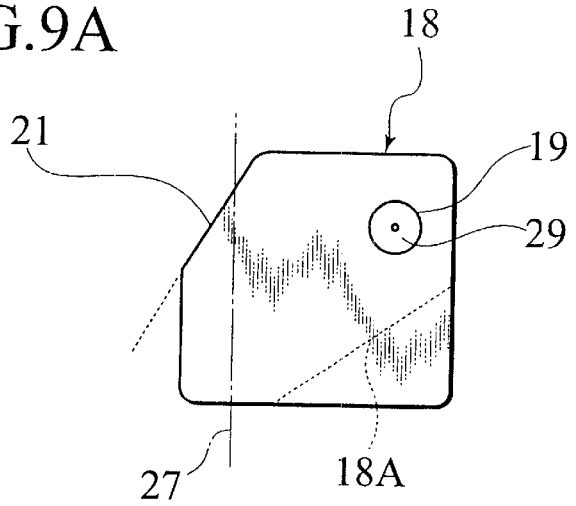
FIG. 9 is a diagram illustrating the action of the lock in a modified embodiment of a power source breaker according to the present invention in the locked state (FIG. 9A) and in the liberated state (FIG. 9B).
Figure 9B:
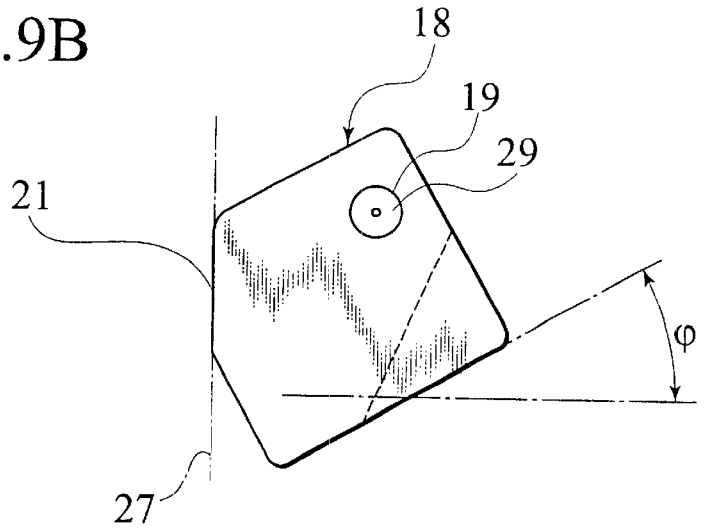

FIG. 9 is a modified embodiment of the power source breakers of the present invention. In the embodiment of FIG. 9A, 9B, adopted is the structure wherein a rotary axle 19 is directly connected to a driving shaft 29 of a rotary actuator 22 and torque of the rotary actuator directly acts as rotation torque of a lock. Explanations for structural members such as a tapered face 21, a end portion 16*a* of a shaft, a side face 27 of the end portion and for liberating movement of the lock are omitted because they are the same as those for the aforementioned embodiment. In the present embodiment, a motor, which a gear system is built in, may be used and it is preferable to use one wherein rotation angle can be controlled.

Further, in FIG. 9, although the rotary axle 19 of the lock is concentric with the driving shaft 29 of the rotary actuator, in the case of using a gear system, however, a direct power transmission mechanism can be adopted even if the rotary axle 19 of the lock is not in line with the driving shaft 29 of the rotary actuator with regard to position or direction. In the present embodiment, since formation of a contact-stop portion and disposition of a rotary disk 24 or a torsion spring 28 become unnecessary, through making the lock 18 smaller by forming another tapered face 18A, the power source breaker 9 can be further miniaturized and made lighter in weight.

As described hereinbefore, according to the present invention, only by changing a rotation angle of the rotary axle of the lock which is assembled rotatable around the central axis of the rotary axle along the plane substantially perpendicular to the sliding direction of the shaft, both constraining the shaft pushed by said release spring at the initial position where a pair of the terminals intervened in the power supply circuit is set in the connected state with each other, and moving the shaft to the isolated position where a pair of the terminals intervened in the power supply circuit is set in the released state are to be done, and therefore the power source breaker using a motor smaller and simpler than a solenoid as a torque generator can be configured.

According to the second embodiment of the present invention, with regard to the utilization of the lock wherein the tapered face is formed on the contact-stop portion of the lock in such a positional relationship as to avoid promptly the interference with the shaft at an instant isolation movement, that is useful to miniaturize the power source breaker through designing a radius of gyration of the lock to be as small as possible.

According to the third embodiment of the present invention, when a circuit-cut signal is input into the rotary actuator, the rotation angle of the rotary axle is changed to release the constraint on the shaft by the lock, and isolation movement of the power source breaker will be surely done in case of abnormalities such as short circuiting of a wire harness, collision of road vehicles.

According to the forth embodiment of the present invention, because the torque generator for operating the lock is a geared motor, whenever any other impulse may be applied onto the power source breaker than those in case of abnormalities such as short circuiting of a wire harness, collision of road vehicles, the constrained state of the shaft can be maintained and it can be avoided that the lock may be released by virtue of the impulse and others resulting in sliding movement of the shaft. Further, since the portion of the lock to be linked to the protrusion of the disk assembled onto a geared motor is released from the protrusion after completion of the isolation movement, the shaft can be immediately reset at the initial position after completion of the isolation movement. Therefore, it is easy to make the power supply circuit return to an electrically closed state.

According to the fifth embodiment of the present invention, since used is the lock eccentric with the rotary axle in such a positional relation as the contact-stop portion of the lock may be larger than the other portion, that is useful to miniaturize the power source breaker through designing a radius of gyration to be as small as possible. According to the present invention, provided is a power source breaker which can forcedly and surely isolate a power supply circuit in case of abnormalities such as short circuiting of a wire harness, collision of road vehicles, and also has a structure suitable for miniaturizing itself.

What is claimed is:

1. A power source breaker having a pair of terminals intervened in a power supply circuit connecting a battery of a road vehicle to loads and having a shaft contacting with and disconnecting from said pair of terminals in sliding movement, said shaft movable from an initial position where each of said pair of terminals is set in a connected state with each other to an isolated position where each of said pair of terminals is set in a released state with each other, resulting in isolation of said power supply circuit, the power source breaker comprising:

a release spring for imparting a pushing force to the shaft to slide said shaft from said initial position to said isolated position; and a lock rotatable around a central axis of a rotary axle along a plane substantially perpendicular to a sliding direction of said shaft; and an interfering portion of said lock for interfering with said shaft at said initial position, and by change of a rotation angle of the rotary axle of said lock, said shaft being movable to said isolated position where said interfering portion does not interfere with said shaft.

2. The power source breaker of claim 1, wherein said lock further comprises a tapered face for contact-stopping said shaft and for interfering with the shaft.

3. The power source breaker of claim 1 or 2, further comprising a rotary actuator, wherein said lock changes the rotation angle around said rotary axle corresponding to rotary movement of said rotary actuator.

4. The power source breaker of claim 3, further comprising:

a disk assembled concentrically with a driving shaft of said rotary actuator, the disk having a protrusion on its periphery; and a link portion formed on a portion of the lock to link with said protrusion for transmitting torque, said link portion being releasable from said protrusion after completion of the isolation of said power supply circuit.

5. The power source breaker of any of claim 1, 2, or 4, wherein said rotary axle is disposed eccentrically with said lock so that a contact-stop portion of the shaft is larger than the interfering portion.

6. The power source breaker of claim 3, wherein said rotary axle is disposed eccentrically with said lock so that a contact-stop portion of the shaft is larger than the interfering portion.

* * * * *